US011268692B2

(12) United States Patent
Travis

(10) Patent No.: US 11,268,692 B2
(45) Date of Patent: Mar. 8, 2022

(54) GAS COOKING GRATE WITH INTEGRAL BURNER

(71) Applicants: BSH Home Appliances Corporation, Irvine, CA (US); BSH Hausgeräte GmbH, Munich (DE)

(72) Inventor: Rob Travis, New Bern, NC (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 469 days.

(21) Appl. No.: 16/212,759

(22) Filed: Dec. 7, 2018

(65) Prior Publication Data

US 2020/0182458 A1 Jun. 11, 2020

(51) Int. Cl.

| | |
|---|---|
| ***F23D 14/08*** | (2006.01) |
| ***F23D 14/04*** | (2006.01) |
| ***F24C 3/08*** | (2006.01) |

(52) U.S. Cl.

CPC ..... *F23D 14/08* (2013.01); *F23D 14/045* (2013.01); *F24C 3/082* (2013.01)

(58) Field of Classification Search

CPC ..... F23D 14/045; F23D 14/06; F24C 3/082
USPC ..... 126/39 E
See application file for complete search history.

(56) References Cited

U.S. PATENT DOCUMENTS

| | | | | |
|---|---|---|---|---|
| 1,016,236 A | | 1/1912 | Stephens et al. | |
| 1,463,592 A | | 7/1923 | Robinson | |
| 1,818,222 A | | 8/1931 | Hughes | |
| 2,344,144 A | * | 3/1944 | Hobson | F24C 15/107 126/39 R |
| 6,148,811 A | * | 11/2000 | Miller | F24C 15/107 126/39 R |
| 6,439,881 B2 | * | 8/2002 | Haynes | F23D 14/06 431/278 |
| 6,508,245 B2 | | 1/2003 | Taplan | |
| 7,881,593 B2 | | 2/2011 | Grassi et al. | |
| 7,967,004 B2 | * | 6/2011 | Inzaghi | F24C 3/085 126/39 K |
| 10,612,788 B2 | * | 4/2020 | Lah | F24C 3/022 |
| 2012/0097148 A1 | | 4/2012 | Schoenemann et al. | |
| 2014/0246009 A1 | | 9/2014 | Tisselli et al. | |
| 2014/0251305 A1 | * | 9/2014 | Rasi | F24C 3/085 126/39 E |

FOREIGN PATENT DOCUMENTS

EP 1207351 A1 5/2002

OTHER PUBLICATIONS

Electolux; Cooktop with built-in grid; Online: Appliancist.com; publication date Jul. 14, 2008.

* cited by examiner

*Primary Examiner* — Jorge A Pereiro
*Assistant Examiner* — Nikhil P Mashruwala
(74) *Attorney, Agent, or Firm* — Michael E. Tschupp; Andre Pallapies; Brandon G. Braun

(57) ABSTRACT

A cooking grate for a domestic gas cooking appliance having a top sheet is provided. The cooking grate includes a cooking utensil support region; and a gas transfer portion extending from the cooking utensil support region and having a gas transfer chamber, a plurality of gas outlets extending from the gas transfer chamber to a burn region outside of the gas transfer portion, and a gas inlet extending from an area outside of the gas transfer portion to the gas transfer chamber.

8 Claims, 5 Drawing Sheets

GAS COOKING GRATE WITH INTEGRAL BURNER

FIELD OF THE INVENTION

The invention is directed to a domestic cooking appliance. More particularly, embodiments of the invention are directed to a gas cooking grate having an integral burner.

An example of an application for the invention is a domestic kitchen gas cooking appliance in which the cooking grate forms a portion of the gas burner.

BACKGROUND OF THE INVENTION

Some modern domestic kitchens include gas cooking appliances such as gas ranges and gas cooktops. Gas ranges and gas cooktops have one or more gas burners that provide cooking heat to a cooking utensil placed on a cooking grate that supports the cooking utensil above a flame provided by the gas burner. Some gas burners include a burner that is attached to, or rests on, a top sheet of the range or cooktop, and a burner cap that rests on the burner body. In these arrangements, the burner body and burner cap are not connected to the cooking grate.

Applicants recognized an improvement to the above arrangement and implement that improvement in embodiments of the invention.

SUMMARY

The invention achieves the benefit of including portions of a burner assembly for a domestic gas cooking appliance in the cooking grate of the cooking appliance.

Embodiments of the invention are based on the inventor's recognition that a gas transfer portion of the burner assembly can be incorporated into the cooking grate.

Particular embodiments of the invention are directed to a cooking grate for a domestic gas cooking appliance having a top sheet. The cooking grate includes a cooking utensil support region; and a gas transfer portion extending from the cooking utensil support region and having a gas transfer chamber, a plurality of gas outlets extending from the gas transfer chamber to a burn region outside of the gas transfer portion, and a gas inlet extending from an area outside of the gas transfer portion to the gas transfer chamber.

In some embodiments, an uppermost surface of the gas transfer portion is vertically below the upper most surface of the cooking utensil support region.

Other embodiments of the invention are directed to a gas burner assembly for a domestic gas cooking appliance having a top sheet. The gas burner assembly includes a cooking grate having a cooking utensil support region, a gas transfer portion extending from the cooking utensil support region, and a gas venturi member. The gas transfer portion includes a gas transfer chamber, a plurality of gas outlets extending from the gas transfer chamber to a burn region outside of the gas transfer portion, and a gas inlet extending from an area outside of the gas transfer portion to the gas transfer chamber. The gas venturi member is configured to extend through an opening in the top sheet, and has a gas inlet that is configured to receive gas from a gas supply, a gas outlet that fluidly aligns with the gas inlet of the gas transfer portion, and a central passageway that is fluidly between the gas inlet of the gas venturi member and the gas outlet of the gas venturi member.

Other embodiments of the invention are directed to a domestic gas cooking appliance having a main cabinet; a top sheet forming an upper surface of the main cabinet; a cooking grate positioned above the top sheet; and a gas venturi member. The cooking grate has a cooking utensil support region configured to support a cooking utensil; a gas transfer portion extending from the cooking utensil support region and having a gas transfer chamber, a plurality of gas outlets extending from the gas transfer chamber to a burn region outside of the gas transfer portion, and a gas inlet extending from an area outside of the gas transfer portion to the gas transfer chamber. The gas venturi member extends through an opening in the top sheet and has a gas inlet that is configured to receive gas from a gas supply, a gas outlet that fluidly aligns with the gas inlet of the gas transfer portion, and a central passageway that is fluidly between the gas inlet of the gas venturi member and the gas outlet of the gas venturi member.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

As explained above, embodiments of the invention provide an improvement to gas cooking appliances.

Figure 1:
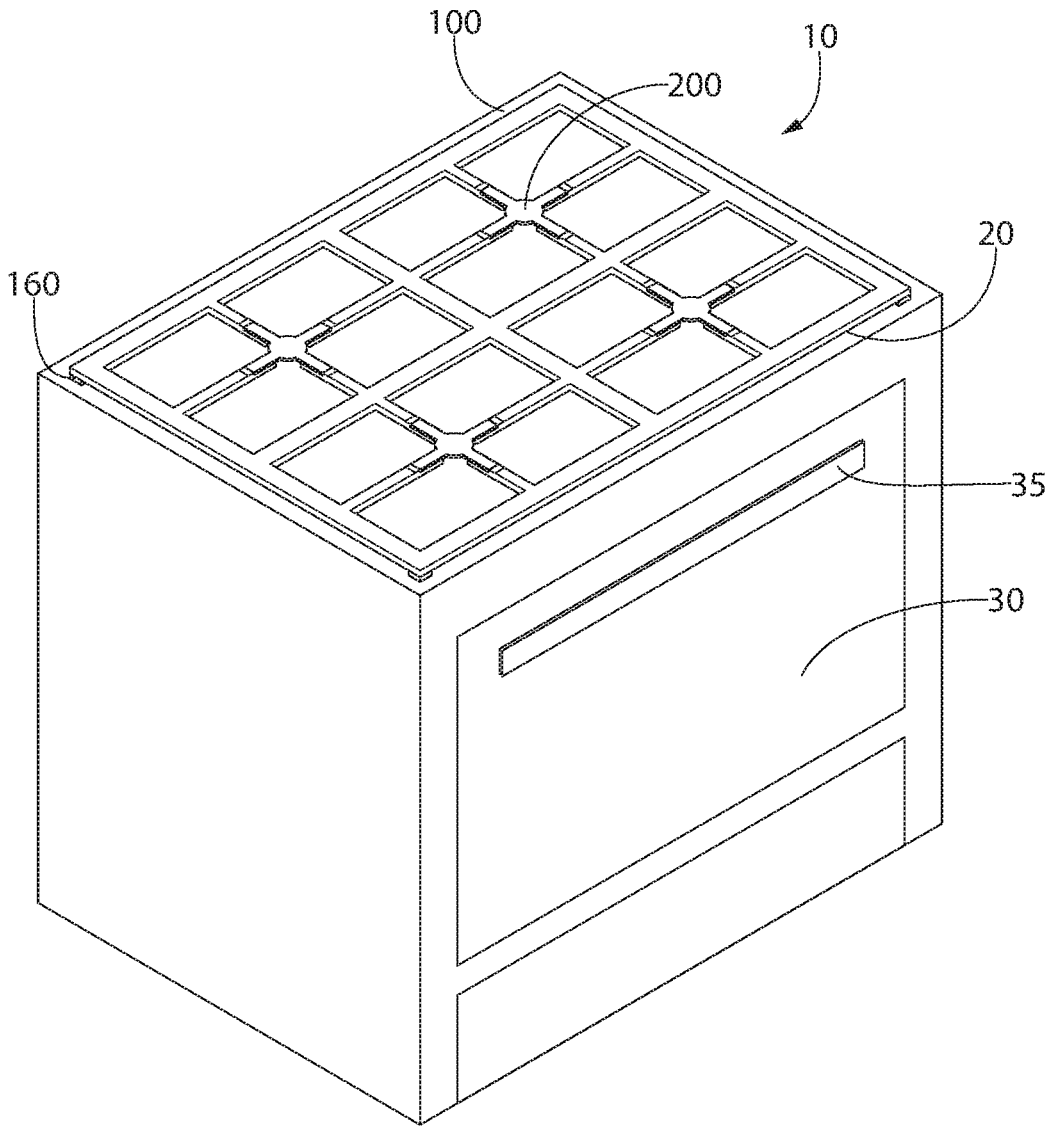
FIG. 1 is a perspective schematic view of an exemplary appliance in accordance with embodiments of the invention.

FIG. 1 shows an example of a gas cooking appliance 10 such as, for example, a gas range in accordance with embodiments of the invention. Other gas cooking appliances in accordance with embodiments of the invention includes gas cooktops or other cooking appliances having one or more gas burners for supplying heat to a cooking utensil supported by a cooking grate. The example in FIG. 1 has a door 30, having a handle 35, which provides access to a cooking chamber. A top sheet 20 is provided on an upper surface of a main housing of gas cooking appliance 10. In exemplary embodiments, top sheet 20 is a sheet metal, such as, for example, stainless steel, member having an upper surface that is visible to a user of appliance 10. In embodiments, top sheet 20 catches spills, drips, or other deposits of food items being heated in a cooking utensil positioned on appliance 10. In other examples, top sheet 20 is a cast metal, a ceramic material, or some other material.

The example shown in FIG. 1 includes a cooking grate 100 that is supported on top sheet 20 by integral extensions 160 that extend downwardly from a main portion of cooking grate 100. Cooking utensils heated by cooking appliance 10 are placed on cooking grate 100 and supported by cooking grate 100 above flame-generating burners (described in detail below).

Figure 2:
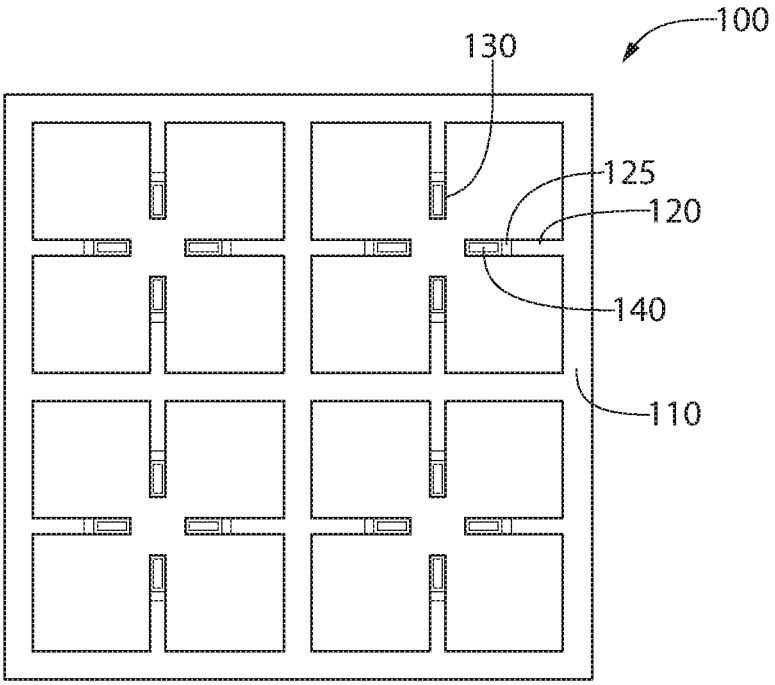
FIG. 2 is a plan view of a cooking grate in accordance with exemplary embodiments of the invention.

FIG. 2 shows an example of cooking grate 100 that has four square utensil support/burner locations arranged symmetrically. Although a cooking utensil can be placed anywhere on cooking grate 100 relative to a burner, in this disclosure a location above a burner will be referred to as a burner location for simplicity. Usually, a cooking utensil is placed above one of the burner locations. Some embodiments have fewer or more than four burner locations. Other embodiments have burner locations that are non-square and non-uniform. For example, embodiments include six burner locations of which four are square and two are rectangular. Cooking grate 100 shown in FIG. 2 is a one-piece cast iron grate. In other embodiments, grate 100 is made of another material such as, for example, a different metal or a ceramic material.

Figure 3:
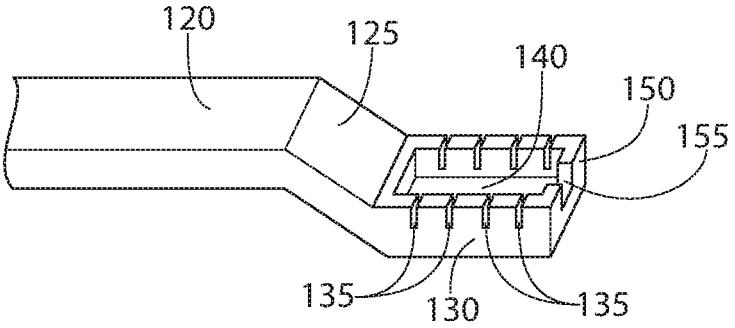
FIG. 3 is a partial perspective view of a cooking grate in accordance with exemplary embodiments of the invention.

The grate 100 shown in FIG. 2 has an outer frame member 110 that surrounds the burner locations. Each of the burner locations in this example has four fingers 120 that extend from outer frame 110, or from another portion of grate 100, toward a central area. As shown in FIG. 3, each finger 120 has a gas transfer portion 130 at its end. A transition portion 125 attaches finger 120 to gas transfer portion 130 and provides an elevation change between finger 120 and gas transfer portion 130.

Gas transfer portion 130 is configured to receive gas from a gas venturi member 300 (described in detail below) and distribute the gas to locations where it is ignited and burned to provide heat to a cooking utensil. FIGS. 3 and 8 show that, in this example, an upper surface of gas transfer portion 130 is at an elevation that is below the elevation of an upper surface of finger 120 due to transition portion 125. Gas transfer portion 130 has an interior volume 140 that is, in this example, open to above. Interior volume 140 has a plurality of gas outlets 135 on both sides of gas transfer portion 130. In other embodiments, interior volume 140 has gas outlets on only one side of gas transfer portion 130. Embodiments have any number of gas outlets 135 on one or both sides of gas transfer portion 130. An end 150 of gas transfer portion 130 is, in this example, curved to follow the shape of gas venturi member 300 (shown in FIGS. 5-7). In other embodiments, end 150 is planar or some other shape. End 150 of gas transfer portion 130 includes a gas inlet 155 that receives a gas outlet 340 of gas venturi member 300. While the example shown in FIG. 3 has one gas inlet 155, other embodiments of the invention have two or more gas inlets 155 in end 150, or in some other portion, of gas transfer portion 130.

Figure 4:
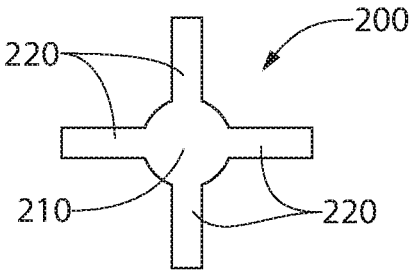
FIG. 4 is a plan view of an example of a burner cap in accordance with embodiments of the invention.

FIG. 4 shows an example of a burner cap 200 that covers interior volume 140 of, in this example, four gas transfer portions 130. The exemplary burner cap 200 shown in FIG. 4 corresponds to cooking grate 100 shown in FIG. 2. Each of four extensions 220 covers one of the four adjacent interior volumes 140 shown in FIG. 2. A central portion 210 of burner cap 200 rests, in this embodiment, on an upper rim of gas venturi member 300 (described in more detail with reference to FIG. 5-7 below). FIG. 8 also shows the relationship of burner cap 200 to gas transfer portions 130 from a side view.

Figure 5:
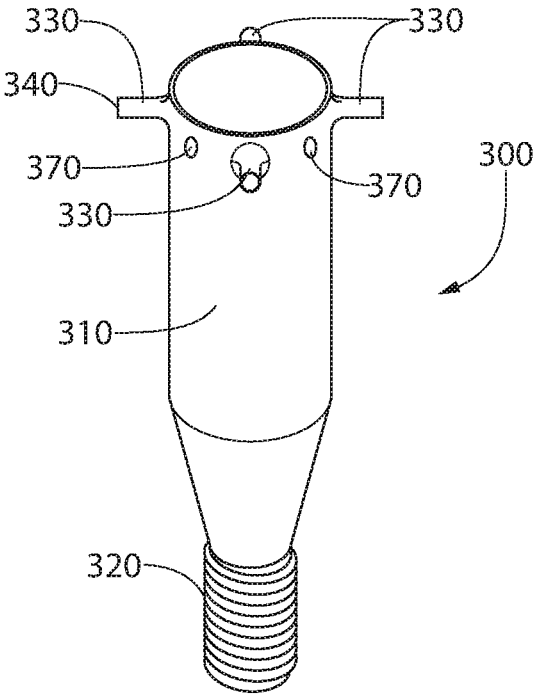
FIG. 5 is a perspective view of an example of a venturi in accordance with embodiments of the invention.
Figure 6:
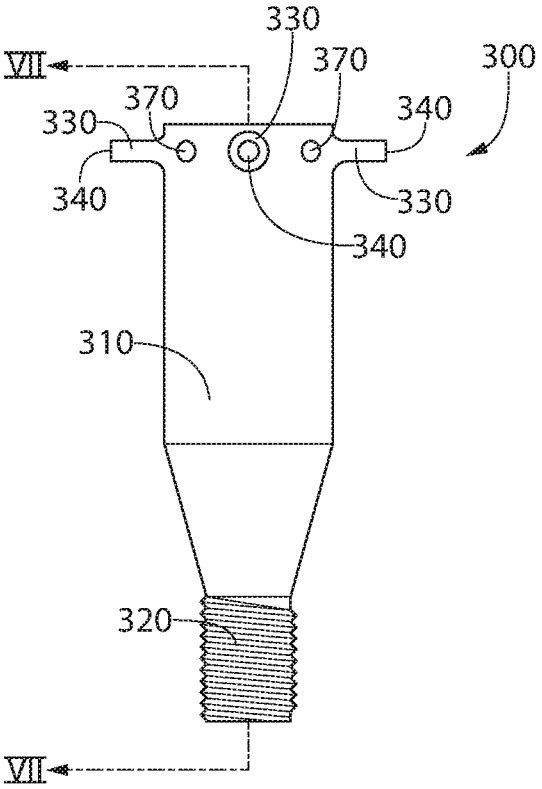
FIG. 6 is a side view of an example of a venturi in accordance with embodiments of the invention.
Figure 7:
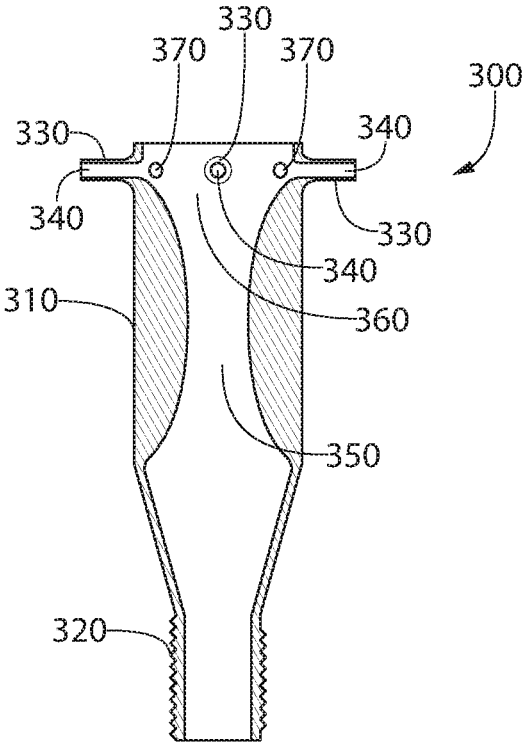
FIG. 7 is a sectional view of an example of a venturi in accordance with embodiments of the invention.
Figure 8:
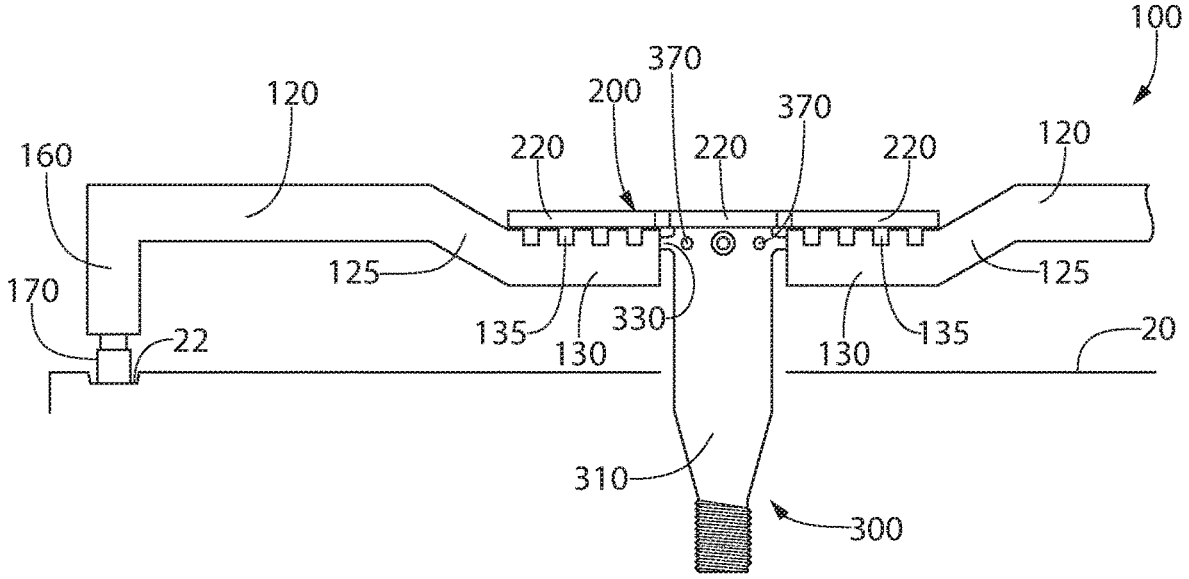
FIG. 8 is a partial side view of a burner assembly in accordance with embodiments of the invention.

FIGS. 5-7 show an example of a gas venturi member 300 in accordance with embodiments of the invention. In this example, gas venturi member 300 has a main body 310 having a central passageway 350 that is, in this example, a gas venturi. Central passageway 350 leads from an inlet end 320 to, in this example, a plurality of gas outlets 340. As described above, each gas outlet 340 extends into one of the gas inlets 155 of gas transfer portions 130 (as shown in FIG. 8). In this example, each gas outlet 340 is in an extension 330 that extends away from main body 310 to enable gas outlet 340 to open into the interior volume 140 of one of the gas transfer portions 130. In some embodiments, extension 330 fits tightly in gas inlet 155 to create a seal between extension 330 and gas inlet 155. In some embodiments, gas outlet 340 does not open into interior volume 140, but instead opens at an outer face of end 150 or outside of the outer face of end 150. While one gas outlet 340 is shown in this example for each gas transfer portion 130, in other embodiments more than one gas outlet 340 feeds a gas transfer portion 130.

In this example, a plurality of bleeder ports 370 are provided around the perimeter of gas venturi member 300. In this example, bleeder ports 370 provide a gas supply that ignites due to their proximity to one or more gas outlets 135 of gas transfer portions 130. Bleeder ports 370 allow one igniter (not shown) to be used to ignite the gas at all gas outlets 135. Depending on the particular design of gas venturi member 300 and gas transfer portion 130, more or fewer bleeder ports 370 may be used and/or the locations of bleeder ports 370 may be altered. For example, in embodiments, one or more bleeder ports 370 are located above and/or to the side of gas outlets 340 to complete a series of bleeder ports between which a flame is passed. In some embodiments, some or all of bleeder ports 370 produce flames that provide heat to the cooking utensil being heated. In the example shown in FIG. 8, flames emitted from bleeder ports 370 extend around and above central portion 210 of burner cap 200 to provide heat to a cooking utensil supported by fingers 120.

In the example shown, inlet end 320 of gas venturi member 300 is threaded so that it threads into a receiving portion in the appliance and forms a gas-tight, sealed connection with a gas supply. In the example shown in FIGS. 5-7, a distribution area 360 is located at the top of central passageway 350 of gas venturi member 300 to distribute the gas from central passageway 350 to gas outlets 340 and bleeder ports 370.

FIG. 8 shows a side view of an embodiment of the invention. In FIG. 8, parts of the cooking grate 100 are removed for clarity. This view shows one of the extensions 160 that extends vertically downward from a utensil support level of cooking grate 100. In embodiments, four, six, or some other number of extensions 160 are used. In this example, each extension 160 has a foot 170 at its end. Foot 170 can be a rubber material or other material. In this example, a recess 22 is provided in top sheet 20 to receive and locate each foot 170. Fingers 120 (and, in some examples, other portions of cooking grate 100) provide support for the cooking utensils placed on cooking grate 100. Transition portions 125 attach gas transfer portions 130 to fingers 120 such that an upper surface of each gas transition portion is at an elevation that is below the elevation of an upper surface of fingers 120. This elevation difference allows burner cap 200 to rest on gas transfer portions 130 with an upper surface of burner cap 200 being located below the elevation of the upper surface of fingers 120. The example shown in FIG. 1 shows an alternate embodiment in which the top surfaces of four burner caps 200 are on the same plane as the top surfaces of fingers 120. Burner performance and esthetics for a particular application of the invention determine what, if any, plane difference results from the shape of transition portions 125.

In the examples shown, an air gap exists between a lower surface of gas transfer portion 130 and top sheet 20 (see FIG. 8). In other embodiments, a foot is provided between gas transfer portion 130 and top sheet 20 such that gas transfer portion 130 is supported by top sheet 130. Feet provided on gas transfer portions 130 can be in addition to, or instead of, feet 170 on extensions 160.

As shown in FIG. 8, in this example a lower surface of burner cap 200 rests on an upper surface of gas transition portion 130 to form a top to interior volume 140 and complete the formation of gas outlets 135 of gas transition portion 130. In some embodiments, burner cap 200 fits uniformly on the upper surface of gas transition portion 130 to form a substantially complete seal between burner cap 200 and gas transition portion 130. In other embodiments, the fit between burner cap 200 and the upper surface of gas transition portion 130 does not create a seal.

Figure 9:
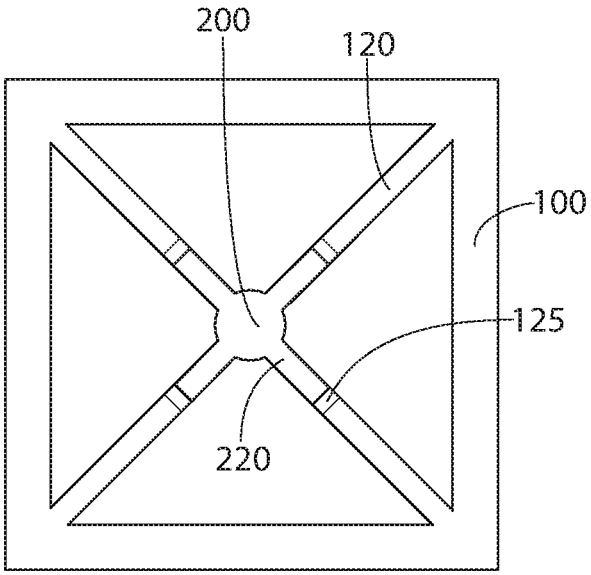
FIG. 9 is a plan view of an alternate example of a burner assembly in accordance with embodiments of the invention.

While FIGS. 1 and 2 show an example of the invention that has four fingers 120 in each burner assembly with fingers 120 arranged parallel to frame members 110 (FIG. 1), other embodiments have fingers 120 arranged in different configurations. For example, FIG. 9 shows an example having four fingers 120 arranged such that fingers 120 form a 45 degree angle with other members of cooking grate 100. Other examples arrange fingers 120 at other angles and in different numbers.

Figure 10:
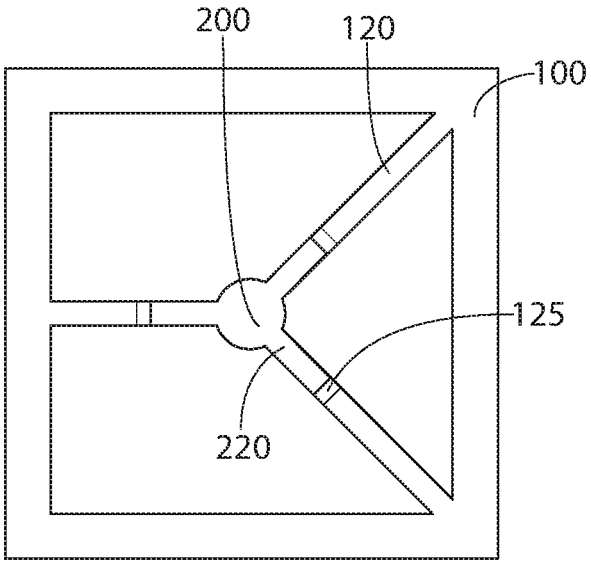
FIG. 10 is a plan view of an alternate example of a burner assembly in accordance with embodiments of the invention.

While FIGS. 1 and 2 show an example of the invention that has four fingers 120 in each burner assembly, other embodiments have a different number of fingers in each burner assembly. For example, FIG. 10 shows an example having three fingers 120 that are arranged at non-uniform angles relative to one another. Other examples arrange fingers 120 at other angles and in different numbers.

It will be appreciated that variants of the above-disclosed and other features and functions, or alternatives thereof, may be combined into many other different systems or applications. Any of the features described above can be combined with any other feature described above as long as the combined features are not mutually exclusive. Various presently unforeseen or unanticipated alternatives, modifications, variations or improvements therein may be subsequently made by those skilled in the art which are also intended to be encompassed by the invention.

What is claimed is:

1. A cooking grate for a domestic gas cooking appliance having a top sheet, the cooking grate comprising:
- a first leg extending toward a center area, the first leg comprising:
  - a first cooking utensil support region; and
  - a first gas transfer portion extending toward the center area from the first cooking utensil support region and having
    - a first gas transfer chamber having an end proximate the center area and opposite to the first cooking utensil support region,
    - a plurality of first gas outlets extending from the first gas transfer chamber to a first burn region outside of the first gas transfer portion, and
    - a first gas inlet in the end of the first gas transfer chamber,
    - wherein the first gas transfer chamber is open to above the first gas transfer chamber.

2. The cooking grate of claim 1, wherein an uppermost surface of the first gas transfer portion is located on in a different plane that an upper most surface of the first cooking utensil support region.

3. The cooking grate of claim 2, wherein the uppermost surface of the first gas transfer portion is vertically below the upper most surface of the first cooking utensil support region.

4. The cooking grate of claim 1, further comprising
- a second leg extending toward the center area, the second leg comprising:
  - a second cooking utensil support region; and
  - a second gas transfer portion extending toward the center area from the second cooking utensil support region and having
    - a second gas transfer chamber having an end proximate the center area and opposite to the second cooking utensil support region,
    - a plurality of second gas outlets extending from the second gas transfer chamber to a second burn region outside of the second gas transfer portion, and
    - a second gas inlet in the end of the second gas transfer chamber.

5. The cooking grate of claim 1, further comprising a foot configured to contact the top sheet of the domestic gas cooking appliance and to support the first cooking utensil support region.

6. The cooking grate of claim 4, wherein the first gas transfer portion and the second gas transfer portion extend toward each other from opposite sides of the center area.

7. A cooking grate for a domestic gas cooking appliance having a top sheet, the cooking grate comprising:
- a first leg extending toward a center area, the first leg comprising:
  - a first cooking utensil support region; and
  - a first gas transfer portion extending toward the center area from the first cooking utensil support region and having
    - a first gas transfer chamber having an end proximate the center area and opposite to the first cooking utensil support region,
    - wherein the first gas transfer portion is configured to receive a burner cap such that the burner cap covers from above the first gas transfer chamber,
    - a plurality of first gas outlets extending from the first gas transfer chamber to a first burn region outside of the first gas transfer portion, and
    - a first gas inlet in the end of the first gas transfer chamber.

8. The cooking grate of claim 7, wherein the second gas transfer portion is configured to receive the burner cap such that the burner cap covers from above the second gas transfer chamber.

* * * * *